US005160910A

United States Patent [19]

Tsuji

[11] Patent Number: 5,160,910

[45] Date of Patent: Nov. 3, 1992

[54] ELECTROMAGNETIC RELAY

[75] Inventor: Hideaki Tsuji, Yamaga, Japan

[73] Assignee: Omron Corporation, Kyoto, Japan

[21] Appl. No.: 533,945

[22] Filed: Jun. 6, 1990

Related U.S. Application Data

[63] Continuation of Ser. No. 446,535, Dec. 6, 1989, abandoned.

[30] Foreign Application Priority Data

| | | | |
|---|---|---|---|
| Dec. 9, 1988 | [JP] | Japan | 63-160721[U] |
| Dec. 9, 1988 | [JP] | Japan | 63-160722[U] |
| Dec. 13, 1988 | [JP] | Japan | 63-162112[U] |
| Dec. 13, 1988 | [JP] | Japan | 63-162113[U] |

[51] Int. Cl.[5] ..... H01H 67/02

[52] U.S. Cl. ..... 335/129; 335/130; 335/121

[58] Field of Search ..... 335/78-85, 335/124, 128, 202, 130-134; 200/295-305

[56] References Cited

U.S. PATENT DOCUMENTS

| | | | |
|---|---|---|---|
| 4,346,359 | 8/1982 | Pirner et al. | 335/128 |
| 4,429,292 | 1/1984 | Schedele | 335/202 |
| 4,825,179 | 4/1989 | Nagamoto et al. | 335/78 |

*Primary Examiner*—Lincoln Donovan
*Attorney, Agent, or Firm*—Fish & Richardson

[57] ABSTRACT

An electromagnetic relay, comprising: a case consisting of a terminal base and a cover fitted thereon; a pair of contact units arranged laterally on the terminal base; an electromagnet unit arranged in the case on a longitudinal end of the contact units; an upper longitudinal insulating wall depending from an upper inner wall surface of the cover between different ones of the contact units; a lower longitudinal insulating wall projecting from an inner surface of the terminal base so as to correspond to the upper longitudinal insulating wall; and an actuating member made of electrically insulating material for transmitting a drive force of an armature of the electromagnet unit to the contact units; a guide structure being defined between a lower end of the upper longitudinal insulating wall and an upper end of the lower longitudinal insulating wall so as to guide movement of the card along a longitudinal direction as it is actuated by an armature of the electromagnet unit to actuate the contact units between two different states of contact. Preferably, the guide structure comprises a longitudinal slot provided in the actuating member to receive a free end of one of the longitudinal insulating walls. Thus, a large stroke of the actuating member is made possible for improved reliability of the contact unit operation without reducing the insulating performance of the longitudinal insulating walls.

14 Claims, 8 Drawing Sheets

ELECTROMAGNETIC RELAY

This application is a continuation of U.S. application Ser. No. 07/446,535, filed Dec. 6, 1989, now abandoned.

TECHNICAL FIELD

The present invention relates to an electromagnetic relay having a plurality of contact units each having a moveable contact piece and at least one fixed contact piece, and a partition wall separating the moveable contact units from each other for electric insulation.

BACKGROUND OF THE INVENTION

According to a conventional electromagnetic relay of this kind, a plurality of contact units are arranged on either side of a partition wall, and an actuating force of an armature of an electromagnet unit is transmitted to the moveable contact pieces of the contact units via an actuating member consisting of an electrically insulating member. Since such an actuating member must not interfere with the partition wall and the fixed contact pieces, the actuating member must be provided with an elongated extension for transmitting the driving force over a certain distance. This distance is required for the partition wall to provide a favorable insulation. Further, the interior of the casing of the relay is provided with a limited space because of the requirement to minimize the external dimensions of the electromagnetic relay. For these reasons, the extension of the actuating member must be elongated.

Hence, some difficulty arises in ensuring the mechanical strength of the actuating piece or its extension. In particular, because the actuating member is exposed to heat generated by arc discharges occurring in switching over the contact points, some care must be taken in order to avoid thermal deformation of the actuating member and its extension.

Further, because such an electromagnetic relay has a very limited internal space, it is difficult to accommodate a guide structure which can guide the movement of the actuating member in a stable fashion.

BRIEF SUMMARY OF THE INVENTION

In view of such problems of the prior art, a primary object of the present invention is to provide an electromagnetic relay which is provided with a mechanically stable and durable actuating member so as to achieve a high level of reliability.

A second object of the present invention is to provide an electromagnetic relay which is provided with a favorable guide structure for guiding the movement of an actuating member for transmitting a driving force of an armature of an electromagnet unit to moveable contact pieces.

A third object of the present invention is to provide an electromagnetic relay which is compact in size.

These and other objects of the present invention are accomplished by providing a electromagnetic relay, comprising: a case consisting of a terminal base and a cover fitted thereon; a pair of contact units arranged laterally on the terminal base; an electromagnet unit arranged in the case on a longitudinal end of the contact units; an upper longitudinal insulating wall depending from an upper inner wall surface of the cover between different ones of the contact units; a lower longitudinal insulating wall projecting from an inner surface of the terminal base so as to correspond to the upper longitudinal insulating wall; and an actuating member made of electrically insulating material for transmitting a drive force of an armature of the electromagnet unit to the contact units; a guide structure being defined between a lower end of the upper longitudinal insulating wall and an upper end of the lower longitudinal insulating wall so as to guide movement of the card along a longitudinal direction as it is actuated by an armature of the electromagnet unit to actuate the contact units between two different states thereof.

Thus, according to this invention, since the electrically insulating actuating member is disposed between the two insulating walls, a favorable insulation between contact units can be ensured by the aforementioned three members, and the stroke of the actuating member can be increased without changing the length of the insulating walls along the fore-and-aft direction. Furthermore, since the actuating member may not be provided with an elongated extension as opposed to the prior art, deformation due to arc discharges can be avoided and the size of the actuating member may be kept small so that drive force can be transmitted with a high responsiveness, and a stable operation is ensured. As the insulating walls provide a guide structure for the actuating member, the contact units receive no interferences and the overall structure is simplified.

According to a preferred embodiment of the present invention, the guide structure comprises a longitudinal slot provided in the actuating member to receive a free end of one of the longitudinal insulating walls, and, alternatively or additionally, the guide structure comprises a slot provided in a free end of one of the longitudinal wall to receive a longitudinal ridge provided in an associated part of the actuating member.

According to a particularly preferred embodiment of the present invention, each of the contact units comprises an electrically insulated member carrying a moveable contact piece, and the actuating member is provided with a pair of lateral wings whose lower surfaces are guided by shoulder portions of the electrically insulated members. Further, each of the electrically insulated members is provided with an elastic extension whose free end adjoins an upper surface of one of the wings of the actuating member. Each of the wings may be provided with a slot for receiving one of the moveable contact pieces of the contact units.

Such an electromagnetic relay is typically equipped with an indicator circuit for indicating its operation by lighting up a light emitting diode. In that case, a circuit board must be incorporated in the case of the electromagnetic relay, and it is desired to support the circuit board in as stable a fashion as possible without requiring a large space within the casing. To achieve this goal, according to a preferred embodiment of the present invention, the electromagnetic relay may comprise a pair of intermediate terminal pieces which are securely attached to the electromagnet unit and electrically connected between a coil of the electromagnet unit and a circuit board, the intermediate terminal pieces mechanically supporting the circuit board. Preferably, the circuit board is clamped between a rib provided on an inner surface of the cover and an upper end a yoke of the electromagnet unit, and a lower end of each of the intermediate terminal pieces is bifurcated so as to be crimped upon one of terminal pieces which are electrically connected to leads of a coil of the electromagnet unit, particularly when the coil consists of a primary coil for magnetizing an iron core of the electromagnet unit.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
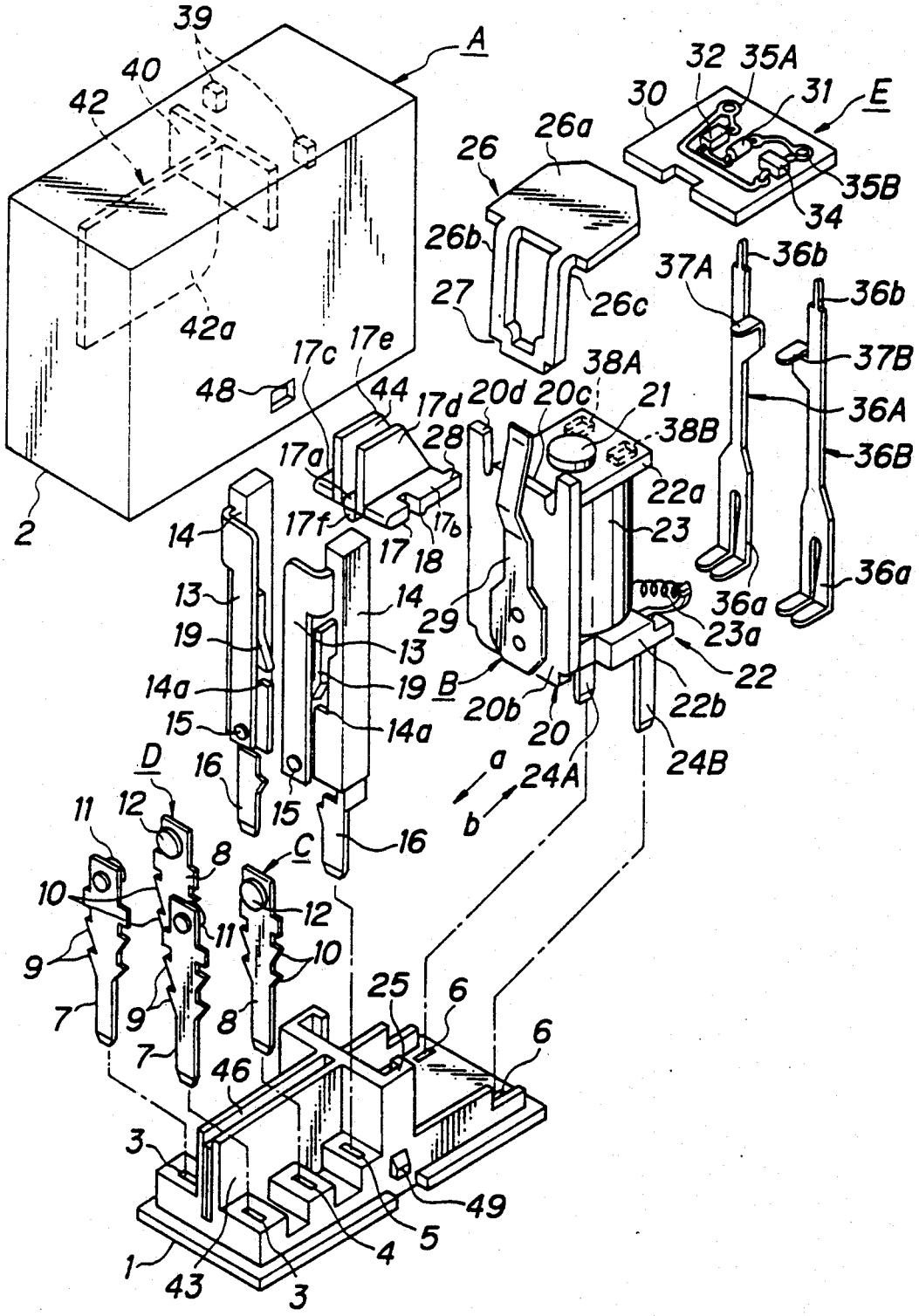
FIG. 1 is an exploded perspective view of a first embodiment of the electromagnetic relay according to the present invention.

Referring to FIG. 1, the electromagnetic relay according to a first embodiment of the present invention basically consists of a case A, an electromagnet block B accommodated in the case A, a pair of contact units C and D, and an electronic circuit unit E.

The case A consists of, for instance, a terminal base 1, and a cover 2 fitted thereon. The terminal base 1 consists of a rectangular and planar member made of electrically insulating synthetic resin, and is provided with a plurality of pairs of terminal piece receiving holes 3, 4, 5 and 6 passed therethrough along either side thereof.

Each of the contact units C and D comprises a normally open fixed contact terminal piece 7 and a normally closed fixed contact terminal piece 8 which are securely press fitted into the terminal piece receiving holes 3 and 4, respectively. These fixed contact terminal pieces 7 and 8 are provided with pointed projections 9 and 10 along their side edges to securely engage with the inner side walls of the terminal piece receiving holes 3 and 4. Numerals 11 and 12 denote normally open and normally closed fixed contact points which are fixedly secured to free end portions of the fixed terminal pieces 7 and 8, respectively, opposite to each other.

Numeral 13 denotes a pair of moveable contact pieces which are integrally molded with insulating columns 14 made of electrically insulating synthetic resin or the like at their upper ends, and carry moveable contact points 15 at their lower end portions or their free end portions for selective contact with the normally open and normally closed contact points 11 and 12, respectively. Moveable contact terminal pieces 16 are also molded with the insulating columns 14 so as to project downwards from their lower ends, and are press fitted into the terminal piece receiving holes 5 in similar manner as the fixed contact terminal pieces 7 and 8. Thus, the contact units C and D each comprise normally open and normally closed fixed contact terminal pieces 7 and 8, normally open and normally closed fixed contact points 11 and 12, a moveable contact piece 13, a moveable contact point 15, an insulating column 14, and a moveable contact terminal piece 16.

Figure 6:
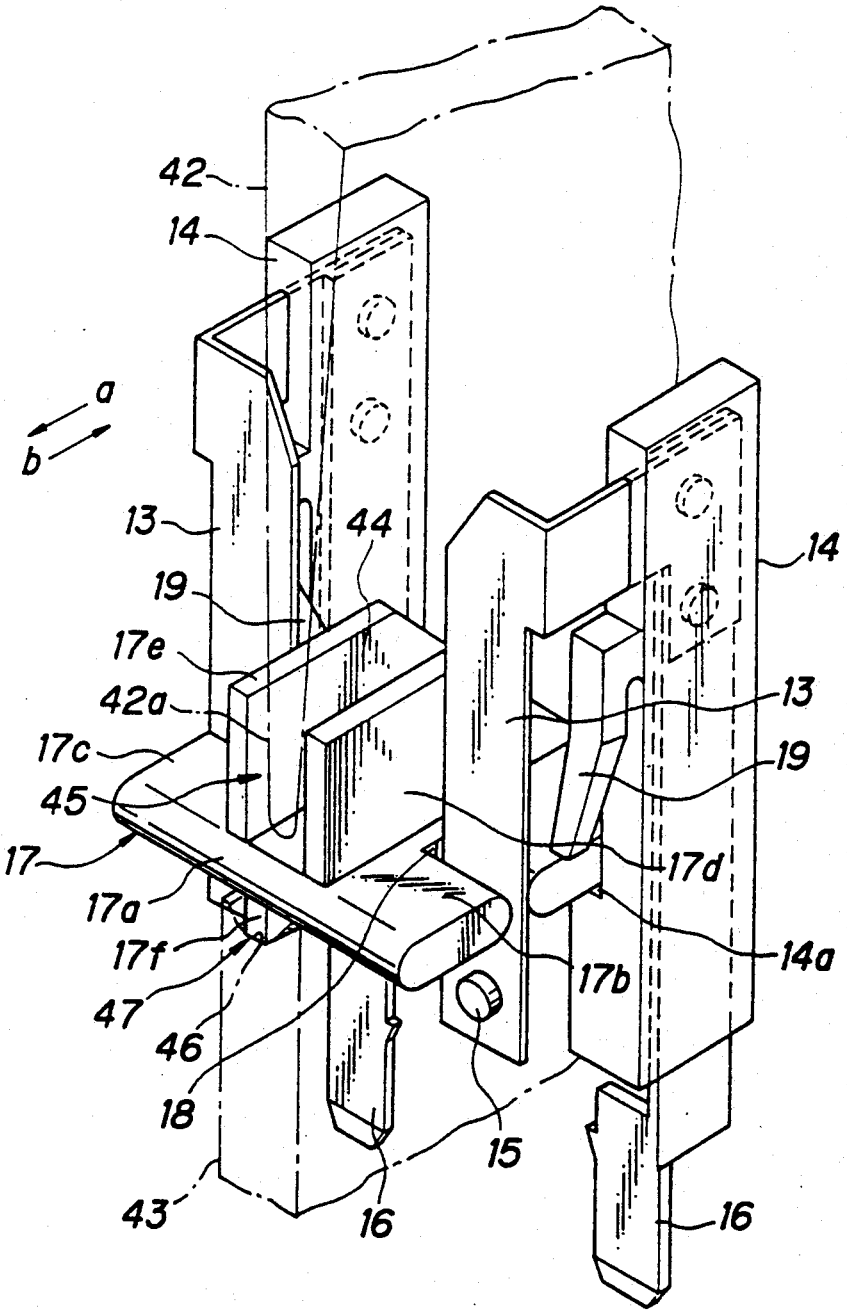
FIG. 6 is an enlarged perspective view of the moveable contact pieces and the mechanism for actuating them.

Numeral 17 denotes an actuating member known as a card and made of synthetic resin or the like for transmitting the drive force of an armature to the moveable contact pieces 13 and 13 belonging to different contact units C and D. As shown in FIG. 6, the card is provided with a planar base portion 17*a*, a pair of wings 17*b* and 17*c* projecting laterally therefrom, a pair of upright walls 17*d* and 17*e* projecting from the upper surface of a middle part of the base portion 17*a*, a ridge 17*f* provided in the lower surface of the middle part of the base portion 17*a*, and a pair of coupling slots 18 provided in the free end edge of the wings 17*b* and 17*c* for receiving free end portions of the moveable contact pieces 13 and 13. Numeral 19 denotes elastic projecting pieces projecting downwards from the associated insulating columns 14 to adjoin the upper surfaces of the wings 17*b* and 17*c* in such a manner that the free ends of the elastic projecting pieces 19 can be elastically deformed by the wings 17*b* and 17*c* of the card 17 when the card 17 is inclined laterally so as to accommodate such a movement of the card 17. The moveable contact pieces 13 are fitted into the slots 18. The lower surfaces of the wings 17*b* and 17*c* of the card 17 abut shoulders 14*a* formed in the insulating columns 14.

Figure 2:
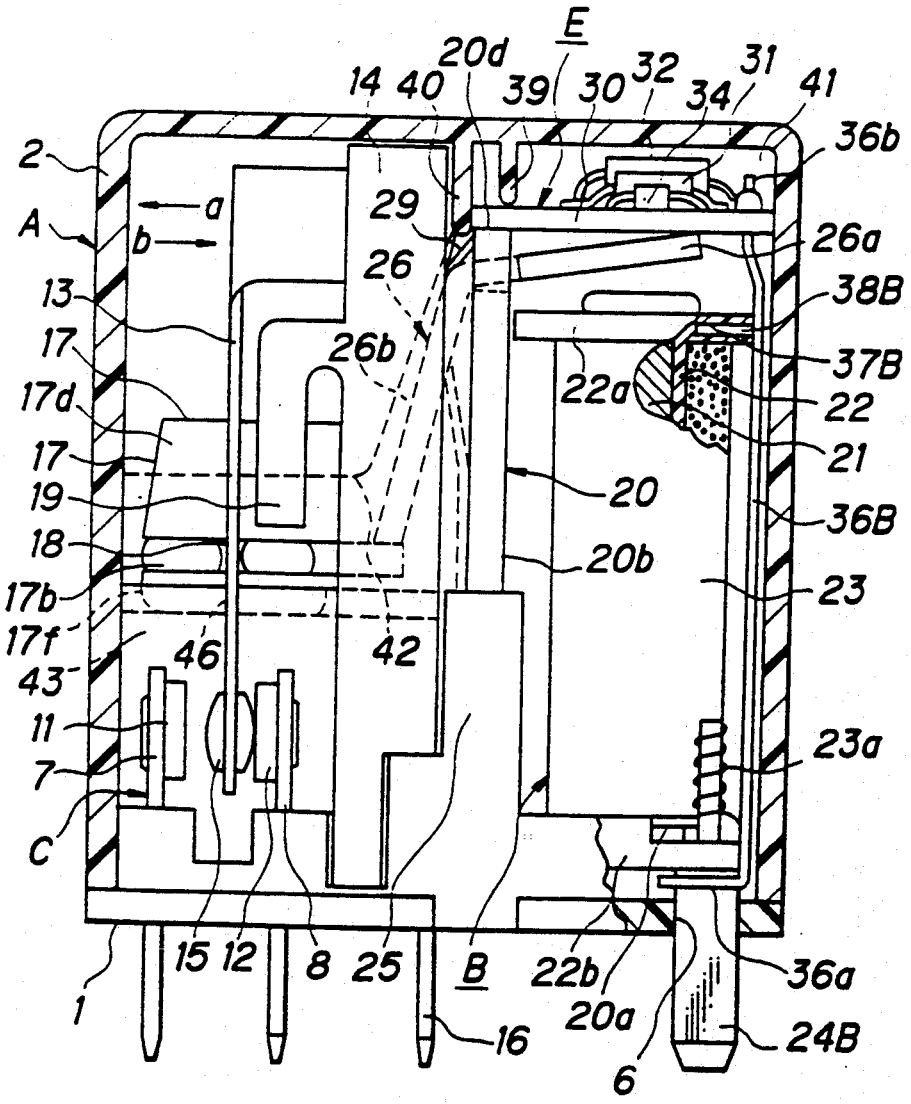
FIGS. 2 and 3 are a sectional side view and a sectional front view, respectively, of the electromagnetic relay of the first embodiment.
Figure 3:
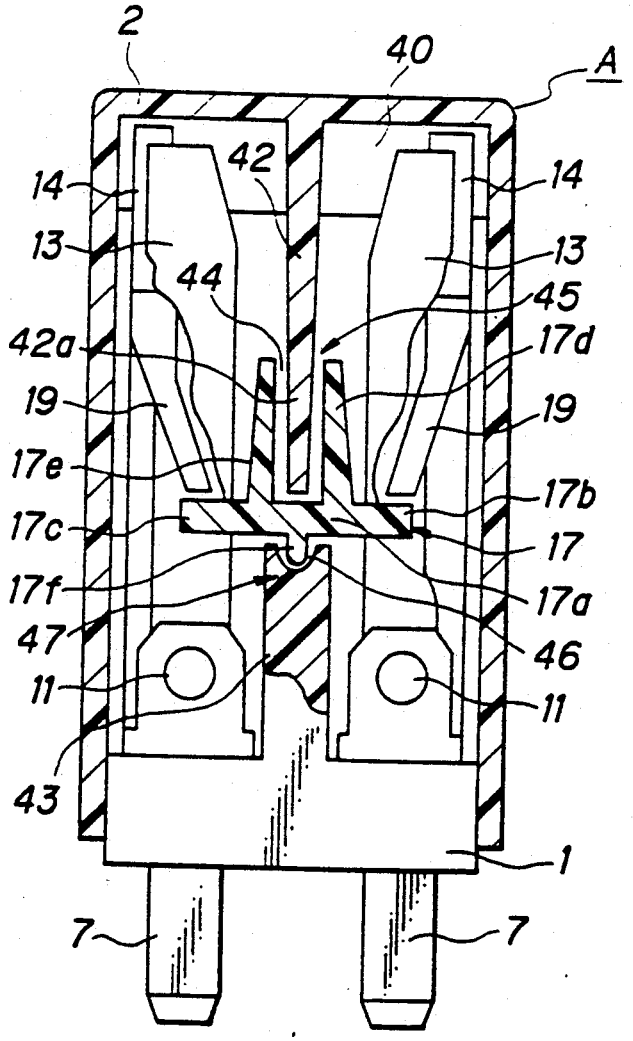

Referring to FIGS. 1 and 2, numeral 20 denotes an L-shaped yoke consisting of a horizontal piece 20*a* and a vertical piece 20*b*, and a base end portion of an iron core 21 is fixedly secured to the horizontal piece 20*b*. Numeral 22 denotes a coil bobbin made of synthetic resin and fitted upon the iron core 21, and is provided with flanges 22*a* and 22*b* at its upper and lower ends. A magnetization coil 23 is wound around the bobbin 22 between its flanges 22*a* and 22*b*. Numerals 24A and 24B denote a pair of coil terminal pieces (power terminal pieces) integrally molded with the lower flange 22*b*, and their outer or lower ends are securely press fitted into the terminal piece receiving holes 6 while their inner or upper ends are connected to leads 23*a* of the energization coil 23 by soldering. The yoke 20, the iron core 21, the coil bobbin 22 and the coil 23 form the electromagnet block B.

Numeral 25 denotes a substantially enclosed insulating wall projecting from the base 1 into the space between the contact units C and D and the electromagnet block B, and the electromagnet block B is secured to the base 1 by press fitting a lower end portion of the yoke 20 into the space enclosed by the enclosed insulating wall 25.

Numeral 26 denotes a substantially L-shaped armature consisting of an attraction piece 26*a* and a drive piece 26*b*, and its corner portion 26*c* is pivotally received by a notch 20*c* formed at the free end of the vertical portion 20*b* of the yoke 20. The free end of the drive piece 26*b* and the rear end of the card 17 are provided with engagement portions 27 and 28 for mutual engagement between the armature 26 and the card 17. Numeral 29 denotes a hinge spring whose base end is fixedly secured to the vertical piece 20*b* of the yoke 20. The free end of the hinge spring 29 elastically presses upon the corner portion 26*c* of the armature 26 from its outer surface.

Figure 4:
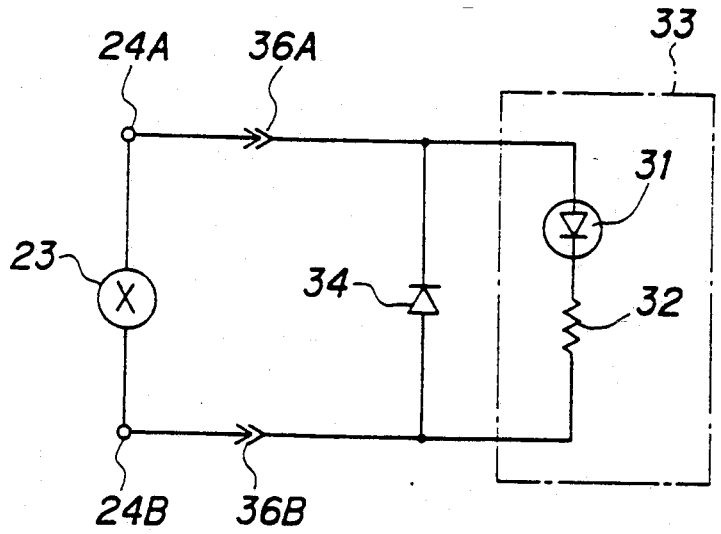
FIG. 4 is a circuit diagram of the electromagnetic relay of the first embodiment.

Numeral 30 denotes a printed circuit board which carries, on its upper surface, an indicator circuit 33 including, as illustrated in FIG. 4, a serial combination of a light emitting diode 31 and a current limiting resistor 32 to be connected across the coil 23, and a diode 34 which is electrically connected across the coil 23 to absorb surge current. The circuit elements 31, 32 and 34, along with the printed circuit board 30, form the circuit unit E. Numerals 35A and 35B denote a pair of terminal connecting holes provided in the printed circuit board 30 to connect the indicator circuit 33 thereto.

Figure 5:
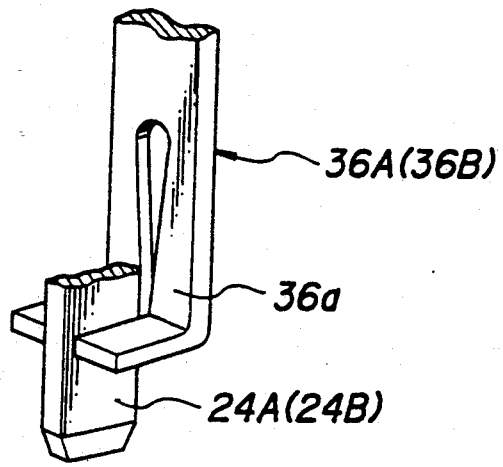
FIG. 5 is an enlarged fragmentary perspective view of a lower part of one of the intermediate terminal pieces.

Numerals 36A and 36B denote a pair of intermediate terminal pieces each of which is fixedly secured to the upper flange 22*a* of the coil bobbin 22 by press fitting a projection 37A or 37B bent from a middle part thereof into a cavity 38A or 38B formed in the outer circumferential surface of the upper flange 22*a*. The lower end portion or 36*b* of each of the intermediate terminal pieces 36A and 36B is formed as a bifurcated gripping engagement portion 36*a* which may grip the associated one of the coil terminal pieces 24A and 24B as illustrated in FIG. 5. The intermediate terminal pieces 36A and 36B securely hold the printed circuit board 30 and are electrically connected to the indicator circuit 33 by their upper ends 36*b* and 36*b* being fitted into the terminal connection holes 35A and 35B of the printed circuit board 30 and soldered therein.

The lower surface of the front portion of the printed circuit board 30 is supported by the upper end surface 20*d* of the vertical piece 20*b* of the yoke 20, and the associated upper surface of the printed circuit board 30 is pressed by a pair of ribs 39 provided in the upper inner wall surface of the cover 2. Numeral 40 denotes an insulating wall depending from the upper inner surface of the cover 2 and extending laterally to locate the printed circuit board 30 by abutting upon the front end surface of the printed circuit board 30 abutting this lateral insulating wall 40, and defines an accommodating space 41 for the indicator circuit 33 and so on in cooperation with the circuit board 30 and the upper inner wall surface of the cover 2.

An upper longitudinal insulating wall 42 depends from the inner surface of the upper wall of the cover 2 and extends from the insulating wall 40 to the front end of the cover 2, between the two contact units C and D, and a lower longitudinal insulating wall 43 rises from the inner surface of the terminal base 1. The card 17 is disposed between the lower end of the upper longitudinal insulating wall 42 and the upper end of the lower longitudinal insulating wall 43 so as to be slidable along the fore-and-aft direction (as indicated by the arrows a and b in FIG. 1).

The free end portion or the lower end portion 42*a* of the upper longitudinal insulating wall 42 is received by a longitudinal slot 44 defined between the two upright walls 17*d* and 17*e* of the card 17 so as to define an upper guide unit 45 for the card 17 by means of the free end 42*a* of the upper longitudinal insulating wall 42 (see FIG. 6). The upper end of the lower longitudinal insulating wall 43 defines a slot 46 for receiving the ridge 17*f* of the card 17 so as to define a lower guide unit 47 for the card 17 with the ridge 17*f* and the slot 46.

Referring to FIG. 1, numeral 48 denotes a pair of engagement holes provided in the side walls of the cover 2 so as to be detachably engaged with associated projections 49 provided in the associated side portions of the terminal base 1.

The mode of operation of this embodiment is now described in the following.

When the coil 23 is energized by supplying electric current thereto from the coil terminals 24A and 24B, an attractive force is generated at the free end surface of the iron core 21. Therefore, the attraction piece 26*a* of the armature 26 is attracted to the free end surface of the iron core 21, and the armature 26 is rotated around its bent corner portion 26*c* to thereby drive the card 17 forwards (as indicated by the arrow a) with its drive piece 27. The forward movement of the card 17 causes forward deflection of the moveable contact pieces 13, and the moveable contact points 15 are removed from the normally closed fixed contact points 12 and come into contact with the normally open fixed contact points 11.

Supplying electric current to the coil 23 causes a voltage to be applied across the indicator circuit 33 via the elastic intermediate terminal pieces 36A and 36B, thus illuminating the light emitting diode 31 to indicate the operating condition of the electromagnetic relay.

When the magnetization of the coil 23 is relieved, the front end surface of the iron core 21 loses its attractive force, and the card 17 recedes in the direction indicated by the arrow b under the spring force of the moveable contact pieces 13, to thereby rotate the armature 26 back to its original position. As a result, the moveable contact points 15 are removed from the normally open fixed contact points 11 and come into contact with the normally closed fixed contact points 12 as they originally were.

Since the card 17 is disposed between the lower end 42*a* of the upper longitudinal insulating wall 42 and the upper end of the lower longitudinal insulating walls 43 between the contact units C and D, a favorable electric insulation is ensured between the contact units C and D, and arc discharges between the contact units can be avoided. Also, the longitudinal walls 42 and 43 increase the surface distance between the contact units C and D, and reduce the possibility of current leaks therebetween.

In particular, because the card 17 is guided between the free ends of the upper and lower longitudinal insulating walls 42 and 43, and the stroke of the card 17 is therefore not affected by the fore-and-aft length of the longitudinal insulating walls 42 and 43 (which is desired in order to ensure a favorable electric insulation by allocating a sufficient fore-and-aft length to the insulating walls 42 and 43), a large card stroke can be easily obtained, and a satisfactory operation of the card units C and D can be ensured.

Further, because the moveable contact pieces 13 can be actuated without providing a forwardly projecting drive piece to the card 17, requirement for mechanical strength of the card 17 is reduced, and its thermal deformation due to arc discharges can be avoided. Thus, the card 17 may be reduced in size, and its movement in actuating the moveable contact pieces 13 is improved in both smoothness and responsiveness so that a significant improvement in operation properties of the electromagnetic relay can be achieved.

Since the lower end of the upper longitudinal insulating wall 42 is received in the slot 44 defined between the upright walls 17*d* and 17*e* on the upper surface of the card 17, and the ridge 17*f* on the lower surface of the card 17 is received by the slot 46 formed in the upper end surface of the lower longitudinal insulating wall 43, the guide structure for the card 17 is simplified by employment the insulating walls 42 and 43, and interferences between the card guide structure and the contact units C and D are avoided.

In the above described embodiment, the upper guide unit 45 for the card 17 is formed by the longitudinal slot 44 defined between the upright walls 17*b* and 17*c* of the card 17 and the free end portion 42*a* of the upper longitudinal insulating wall 42, and the lower guide unit 47 is formed by the ridge 17*f* of the card 17 and the slot 46 of the lower longitudinal insulating wall 43, but the structure of the upper and lower guide units 45 and 47 are only given as an example, and, obviously, there are various possible modifications.

Figure 7:
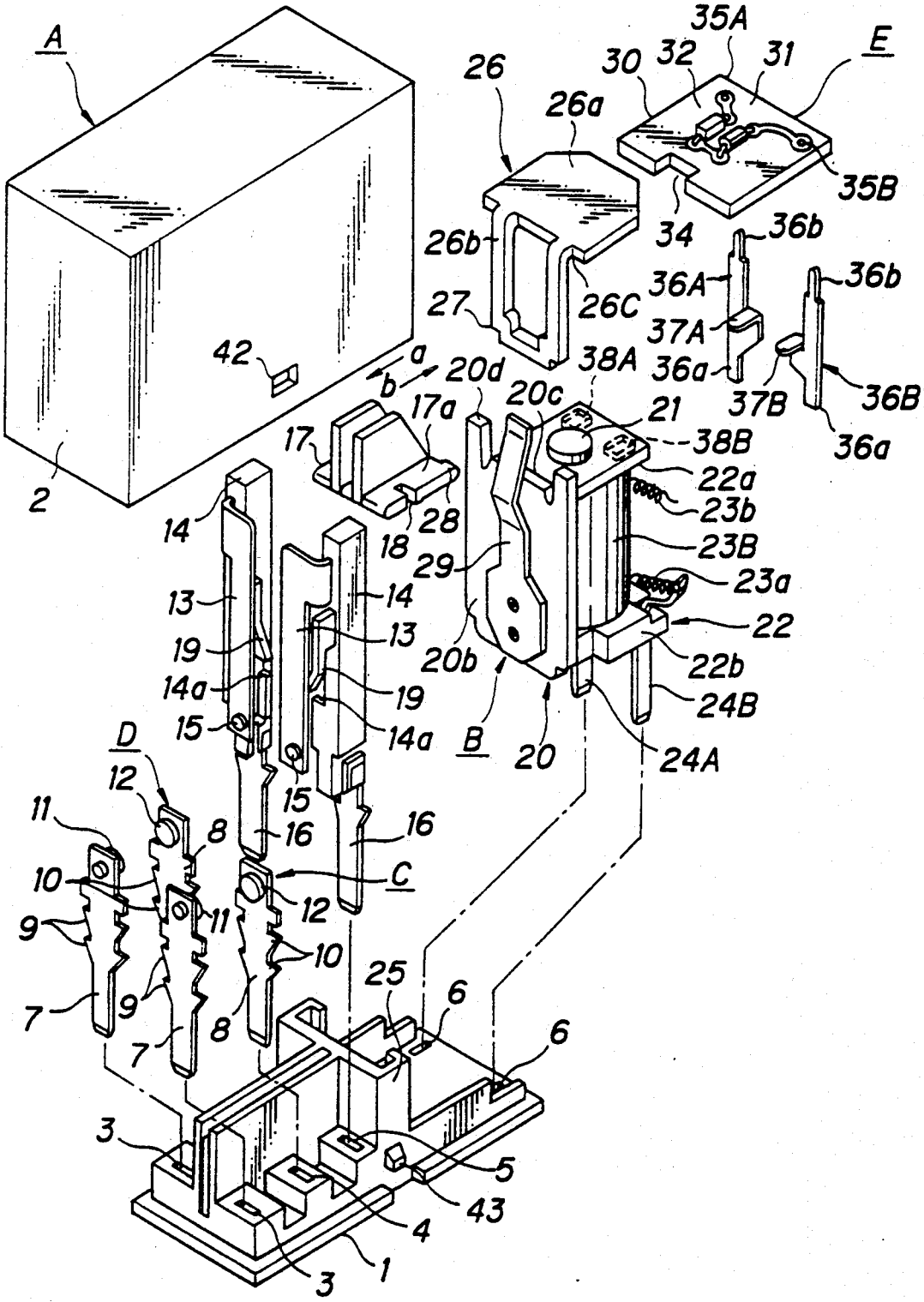
FIG. 7 is an exploded perspective view of a second embodiment of the electromagnetic relay according to the present invention.
Figure 8:
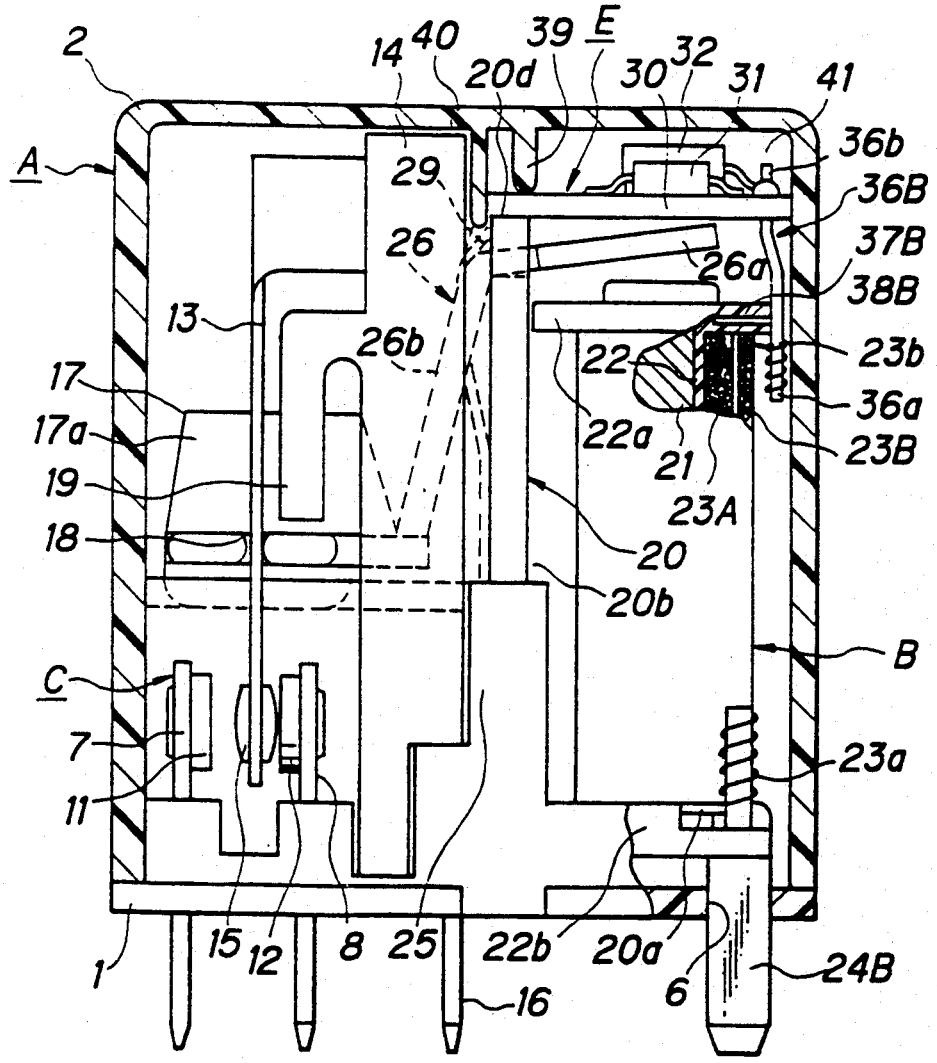
FIG. 8 is a sectional side view of the electromagnetic relay of the second embodiment.
Figure 9:
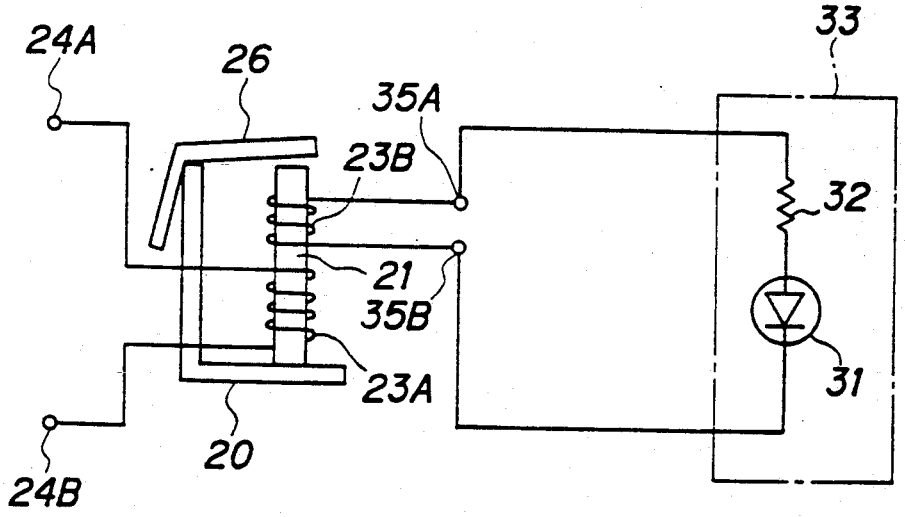
FIG. 9 is a circuit diagram of the electromagnetic relay of the second embodiment.

FIGS. 7 through 9 show a second embodiment of the present invention. According to this embodiment, the electromagnet unit comprises a secondary coil 23B which is wound around a primary coil 23*a* for magnetizing the iron core 21. Electric current is induced in the secondary coil 23B when the iron core 21 is magnetized and demagnetized, and the induced current is supplied to the indicator circuit 33 (FIG. 9). Since leads 23*b* of the secondary coil 23B are provided in the upper end thereof, the intermediate terminal pieces 36A and 36B of the present embodiment have a smaller length than those of the previous embodiment, and the lower ends of the intermediate terminal pieces 36A and 36B are located adjacent to the upper end of the coils 23A and 23B. The leads 23*b* of the secondary coil 23B are connected to the lower ends of the intermediate terminal pieces by soldering. Otherwise, the intermediate terminal pieces 36A and 36B are similar to those of the previous embodiment.

What we claim is:

1. An electromagnetic relay comprising:

a case having a terminal base and a cover fitted thereon;

a pair of contact units arranged laterally on said terminal base;

an electromagnet unit arranged in said case on a longitudinal end of said contact units;

an upper longitudinal insulating wall projecting from an upper inner wall surface of said cover between said contact units.

a lower longitudinal insulating wall projecting from an inner surface of said terminal base so as to correspond to said upper longitudinal insulating wall;

actuation means made of electrically insulating material for transmitting a drive force of an armature of said electromagnet unit to said contact units; and guide means defined between a lower end of said upper longitudinal insulating wall and an upper end of said lower longitudinal insulating wall for guiding said actuation means longitudinally between said upper and lower longitudinal insulating walls as it is actuated by an armature of said electromagnet unit to actuate said contact units between two different states thereof.

2. An electromagnetic relay according to claim 1, wherein said guide means comprises a longitudinal slot provided in said actuation means to receive a free end of one of said longitudinal insulating walls.

3. An electromagnetic relay according to claim 1, wherein said guide means comprises a longitudinal slot provided in a free end of one of said longitudinal walls to receive a longitudinal ridge provided in an associated part of said actuating means.

4. An electromagnetic relay, comprising:

a case having a terminal base and a cover fitted thereon;

a pair of contact units arranged laterally on said terminal base;

an electromagnetic unit arranged in said case on a longitudinal end of said contact units;

an upper longitudinal insulating wall projecting from an upper inner wall surface of said cover between different ones of said contact units;

a lower longitudinal insulating wall projecting from an inner surface of said terminal base so as to correspond to said upper longitudinal insulating wall; and an actuating member made of electrically insulating material for transmitting a drive force of an armature of said electromagnet unit to said contact units;

a guide structure being defined between a lower end of said upper longitudinal insulating wall and an upper end of said lower longitudinal insulating wall so as to guide movement of said actuating member along a longitudinal direction as it is actuated by an armature of said electromagnet unit to actuate said contact units between two different states thereof;

wherein said guide structure comprises a longitudinal slot provided in said actuating member to receive a free end of one of said longitudinal insulating walls; and wherein each of said contact units comprises an electrically insulated member carrying a moveable contact piece, and said actuating member is provided with a pair of lateral wings whose lower surfaces are guided by shoulder portions of said electrically insulated members.

5. An electromagnetic relay according to claim 4, wherein each of said electrically insulated members is provided with an elastic extension whose free end adjoins an upper surface of one of said wings of said actuating member.

6. An electromagnetic relay according to claim 5, wherein each of said wings is provided with a slot for receiving one of the moveable contact pieces of said contact units.

7. An electromagnetic relay, comprising:

a case having a terminal base and a cover fitted thereon;

a pair of contact units arranged laterally on said terminal base;

an electromagnet unit arranged in said case on a longitudinal end of said contact units;

an upper longitudinal insulating wall projecting from an upper inner wall surface of said cover between different ones of said contact units;

a lower longitudinal insulating wall projecting from an inner surface of said terminal base so as to correspond to said upper longitudinal insulating wall; and an actuating member made of electrically insulating material for transmitting a drive force of an armature of said electromagnet unit to said contact units;

a guide structure being defined between a lower end of said upper longitudinal insulating wall and an upper end of said lower longitudinal insulating wall so as to guide movement of said actuating member along a longitudinal direction as it is actuated by an armature of said electromagnet unit to actuate said contact units between two different states thereof;

wherein said guide structure comprises a slot provided in a free end of one of said longitudinal walls to receive a longitudinal ridge provided in an associated part of said actuating member; and wherein each of said contact units comprises an electrically insulated member carrying a moveable contact piece, and said actuating member is provided with a pair of lateral wings whose lower surfaces are guided by shoulder portions of said electrically insulated members.

8. An electromagnetic relay according to claim 7, wherein each of said electrically insulated members is provided with an elastic extension whose free end adjoins an upper surface of one of said wings of said actuating member.

9. An electromagnetic relay according to claim 8, wherein each of said wings is provided with a slot for receiving one of the moveable contact pieces of said contact units.

10. An electromagnetic relay, comprising:

a case having a terminal base and a cover fitted thereon;

a pair of contact units arranged laterally on said terminal base;

an electromagnetic unit arranged in said case on a longitudinal end of said contact units;

an upper longitudinal insulating wall projecting from an upper inner wall surface of said cover between different ones of said contact units;

a lower longitudinal insulating wall projecting from an inner surface of said terminal base so as to correspond to said upper longitudinal insulating wall; and an actuating member made of electrically insulating material for transmitting a drive force of an armature of said electromagnet unit to said contact units; and a guide structure being defined between a lower end of said upper longitudinal insulating wall and an upper end of said lower longitudinal insulating wall so as to guide movement of said actuating member along a longitudinal direction as it is actuated by an armature of said electromagnet unit to actuate said contact units between two different states thereof;

further comprising a pair of intermediate terminal pieces which are securely attached to said electromagnet unit and electrically connected between a coil of said electromagnet unit and a circuit board, said intermediate terminal pieces mechanically supporting said circuit board.

11. An electromagnetic relay according to claim 10, wherein said circuit board is clamped between a rib provided on an inner surface of said cover and an upper end a yoke of said electromagnet unit.

12. An electromagnetic relay according to claim 11, wherein a lower end of each of said intermediate terminal pieces is bifurcated so as to be crimped upon one of terminal pieces which are electrically connected to leads of a coil of said electromagnet unit.

13. An electromagnetic relay according to claim 12, wherein said coil consists of a primary coil for magnetizing an iron core of said electromagnet unit.

14. An electromagnetic relay according to claim 10, wherein said coil consists of a secondary coil wound around a same iron core as a primary coil for magnetizing said iron core.

* * * * *